US008651841B2

(12) United States Patent
Byun et al.

(10) Patent No.: US 8,651,841 B2
(45) Date of Patent: Feb. 18, 2014

(54) ROTARY COMPRESSOR WITH IMPROVED CONNECTION

(75) Inventors: Sang-Myung Byun, Changwon (KR); Sang-Mo Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 516 days.

(21) Appl. No.: 13/056,421

(22) PCT Filed: Jul. 30, 2009

(86) PCT No.: PCT/KR2009/004257

§ 371 (c)(1),
(2), (4) Date: Jan. 28, 2011

(87) PCT Pub. No.: WO2010/016684

PCT Pub. Date: Feb. 11, 2010

(65) Prior Publication Data

US 2011/0135529 A1 Jun. 9, 2011

(30) Foreign Application Priority Data

Aug. 5, 2008 (KR) ..... 10-2008-0076680
Aug. 5, 2008 (KR) ..... 10-2008-0076681

(51) Int. Cl.
*F04C 2/00* (2006.01)
*F01C 20/18* (2006.01)

(52) U.S. Cl.
USPC ..... 418/23; 418/24

(58) Field of Classification Search
USPC ..... 418/16, 21, 22, 23, 24
See application file for complete search history.

(56) References Cited

U.S. PATENT DOCUMENTS

| | | | | |
|---|---|---|---|---|
| 4,240,774 | A * | 12/1980 | Ladusaw | 418/248 |
| 6,257,846 | B1 * | 7/2001 | Muramatsu et al. | 417/410.3 |
| 7,435,063 | B2 * | 10/2008 | Tadano et al. | 417/572 |
| 7,540,727 | B2 * | 6/2009 | Byun et al. | 418/26 |
| 7,585,163 | B2 * | 9/2009 | Nishikawa et al. | 418/23 |
| 7,665,973 | B2 * | 2/2010 | Hwang | 417/310 |
| 7,775,782 | B2 * | 8/2010 | Choi et al. | 418/23 |
| 2007/0154329 | A1 | 7/2007 | Onoda | |
| 2007/0243079 | A1 | 10/2007 | Lee et al. | |

FOREIGN PATENT DOCUMENTS

| | | |
|---|---|---|
| CN | 1510303 | 7/2004 |
| CN | 101052808 | 10/2007 |
| CN | 101054977 | 10/2007 |
| CN | 101187373 | 5/2008 |

OTHER PUBLICATIONS

International Search Report issued in PCT Application No. PCT/KR2009/004257 dated Sep. 14, 2010.

* cited by examiner

*Primary Examiner* — Mary A Davis
(74) *Attorney, Agent, or Firm* — KED & Associates LLP

(57) ABSTRACT

Disclosed is a rotary compressor in which a connecting protrusion is formed at an inner circumferential surface of a vane chamber in which a connection tube is inserted, so as to increase a sealing area between the connection hole and the connection tube, and the size of the connection hole is definitely designated so as to prevent the deformation of the cylinder when press-fitting the connection tube into the connection hole, whereby an amount of leaked refrigerant from the vane chamber can remarkably be reduced and accordingly a fast and accurate mode switching of the vane can be achieved, thereby improving the performance of the compressor and preventing noise caused by vibration of the vane in advance.

20 Claims, 10 Drawing Sheets

ROTARY COMPRESSOR WITH IMPROVED CONNECTION

TECHNICAL FIELD

The present invention relates to a rotary compressor, and more particularly, a rotary compressor capable of enhancing a sealing force between a mode switching unit for switching an operation mode of the compressor and a chamber.

BACKGROUND ART

In general, a refrigerant compressor is applied to a vapor compression type refrigerating cycle (hereinafter, referred to as 'refrigerating cycle'), such as a refrigerator or an air conditioner. A constant-speed type compressor driven at constant speed and an inverter type compressor capable of controlling rotation speed have been introduced as the refrigerant compressor.

The refrigerant compressors are categorized as follows. A refrigerant compressor, in which a driving motor (typically, an electric motor) and a compression part operated by the driving motor are all installed in an inner space of a hermetic casing, is referred to as a hermetic type compressor, and a compressor of which the driving motor is separately installed outside the casing is referred to as an open type compressor. Home or commercial cooling apparatuses usually employ the hermetic type compressor. The refrigerant compressors may be categorized into a reciprocating type, a scroll type, a rotary type and the like according to a refrigerant compression mechanism.

The rotary compressor compresses a refrigerant by use of a rolling piston eccentrically rotating in a compression space of a cylinder and a vane contacted with a rolling piston for partitioning the compression space of the cylinder into a suction chamber and a discharge chamber. In recent time, a variable capacity type rotary compressor capable of varying a cooling capacity of the compressor according to the change in a load has been introduced. Well-known technologies for varying the cooling capacity of the compressor include applying an inverter motor, and varying a volume of a compression chamber by bypassing part of a compressed refrigerant out of a cylinder. However, for employing the inverter motor, a driver for driving the inerter motor is about 10 times as expensive as a driver of a constant-speed motor, thereby rising a fabrication cost of the compressor. On the other hand, for bypassing the refrigerant, a piping system becomes complicated and accordingly a flow resistance of the refrigerant is increased, thereby lowering efficiency of the compressor.

Considering such drawbacks, a so-called modulation type variable capacity rotary compressor, in which at least one or more cylinders are provided and at least one of them is allowed for idling, has been introduced. The modulation type variable capacity rotary compressors may be categorized into a compressor employing a forward pressure mechanism and a compressor employing a recoil pressure mechanism according to a vane restriction method. For instance, the compressor employing the forward pressure mechanism is configured such that a discharge pressure is applied via a suction hole and accordingly a vane is pushed backwardly by pressure of a compression space so as to be restricted, while the compressor employing the recoil pressure mechanism is configured such that a back pressure of suction pressure or discharge pressure is applied to a rear side of the vane so as to selectively restrict the vane. The present invention is applied to a modulation type variable capacity rotary compressor (hereinafter, referred to as 'rotary compressor') employing the recoil pressure mechanism.

The related art rotary compressor uses a connection tube between a connection pipe of a mode switching unit and a rear side of a vane when coupling the mode switching unit in order to apply a back pressure to the rear side of the vane. However, the connection tube cannot have a sufficient sealing area at the rear side of the vane, and accordingly a leakage of refrigerant may occur. As a result, a pressure of the rear side of the vane cannot be quickly changed, which may cause vibration of the vane, thereby lowering the performance of the compressor or increasing noise thereof.

Furthermore, while press-fitting the connection tube into a connection hole of the cylinder, the periphery of the connection hole of the cylinder is swollen, to which may cause the generation of gaps between the cylinder and bearings covering both upper and lower sides of the cylinder, thereby causing a refrigerant to be leaked from the rear side of the vane or a compression space, resulting in concern about lowering of the performance of the compressor.

DISCLOSURE

Technical Solution

Therefore, to solve the problems of the related art rotary compressor, an object of the present invention is to a rotary compressor capable of preventing the leakage of refrigerant, which supports the vane, by ensuring a sealing area between the connection tube and the rear side of the vane.

Another object of the present invention is to provide a rotary compressor capable of reducing the deformation of the cylinder when press-fitting the connection tube and accordingly preventing the leakage of refrigerant between the cylinder and bearings, resulting in improvement of the performance of the compressor.

To achieve these and other advantages and in accordance with the purpose of the present invention, as embodied and broadly described herein, there is provided a rotary compressor including, at least one cylinder installed in an inner space of a hermetic container, having a compression space for compressing a refrigerant, and provided with a chamber isolated within the inner space of the hermetic container, a plurality of bearings coupled to both upper and lower sides of the cylinder so as to cover the compression space of the cylinder and the chamber, at least one rolling piston configured to compress the refrigerant by being orbited in the compression space of the cylinder, at least one vane slidably coupled to the cylinder and configured to partition the compression space into a suction chamber and a discharge chamber in cooperation with the rolling piston, at least one thereof being supported by a refrigerant filled in the chamber of the cylinder, and a mode switching unit configured to vary an operation mode of the compressor by selectively supplying a refrigerant of suction pressure or a refrigerant of discharge pressure to the chamber of the cylinder, wherein the is cylinder is provided with a connection hole for allowing the chamber to be communicated with the mode switching unit, the chamber of the cylinder being provided with a connecting protrusion protruded from an inner circumferential surface thereof with being stepped.

In another aspect of the present invention, there is provided a rotary compressor including, at least one cylinder installed in an inner space of a hermetic container, having a compression space for compressing a refrigerant, and provided with a chamber isolated within the inner space of the hermetic container, a plurality of bearings coupled to both upper and lower sides of the cylinder so as to cover the compression space of the cylinder and the chamber, at least one rolling piston configured to compress the refrigerant by being orbited in the compression space of the cylinder, at least one vane slidably coupled to the cylinder and configured to partition the compression space into a suction chamber and a discharge chamber in cooperation with the rolling piston, at least one thereof being supported by a refrigerant filled in the chamber of the cylinder, and a mode switching unit configured to vary an operation mode of the compressor by selectively supplying a refrigerant of suction pressure or a refrigerant of discharge pressure to the chamber of the cylinder, wherein one of the bearings is provided with a connection hole for connecting the mode switching unit to the chamber, and a connecting protrusion is formed at an inner circumferential surface at a chamber side of the connection hole with being stepped.

Advantageous Effect

In the rotary compressor according to the present invention, the connecting protrusion is formed at the inner circumferential surface of the vane chamber so as to increase a sealing area between the connection hole and the connecting tube connected to the vane chamber, and the size of the connection hole is definitely designated so as to prevent the deformation of the cylinder when press-fitting the connection tube into the connection hole. Accordingly, the sealing area between the connection hole and the connection tube is increased so as to remarkably reduce the amount of leaked refrigerant from the vane chamber, and also a fast and accurate mode switching of the vane can be achieved so as to improve the performance of the compressor and prevent noise generation due to the vibration of the vane in advance.

MODE FOR INVENTION

Description will now be given in detail of a rotary compressor in accordance with one embodiment of the present invention, with reference to the accompanying drawings.

Figure 1:
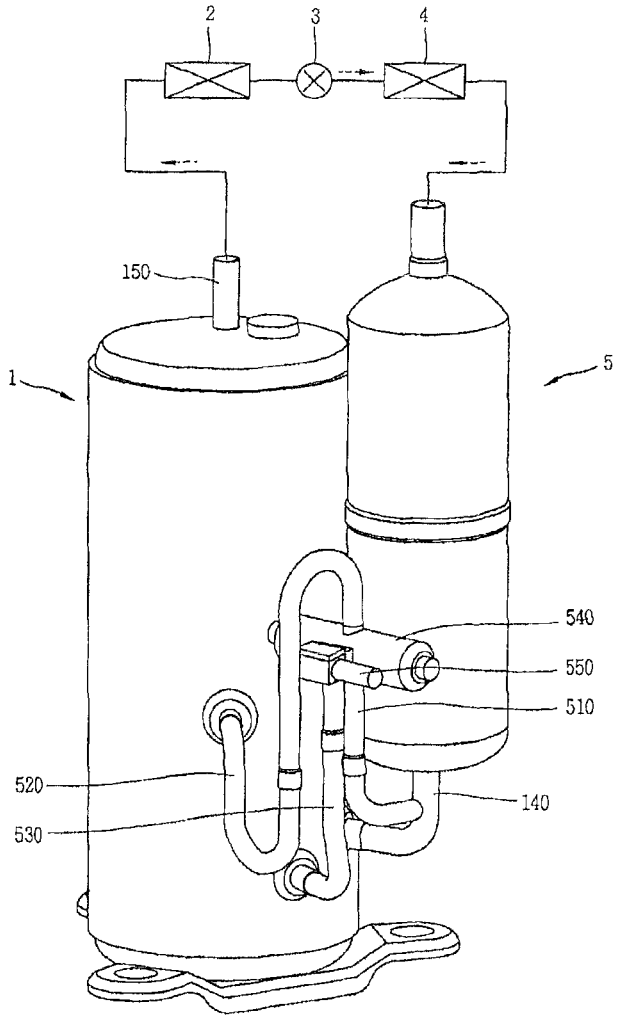
FIG. 1 is a schematic view of a refrigerating cycle including a variable capacity type rotary compressor in accordance with the present invention.

As shown in FIG. 1, a variable capacity type rotary compressor 1 according to the present invention may be configured such that a suction side thereof is connected to an outlet side of an evaporator 4 and simultaneously a discharge side thereof is connected to an inlet side of a condenser 2 so as to form a part of a closed loop refrigerating cycle including the condenser 2, an expansion apparatus 3 and the evaporator 4. An accumulator 5 for separating a refrigerant carried from the evaporator 4 to the compressor 1 into a gaseous refrigerant and a liquid refrigerant may be connected between the discharge side of the evaporator 4 and the inlet side of the compressor 1.

Figure 2:
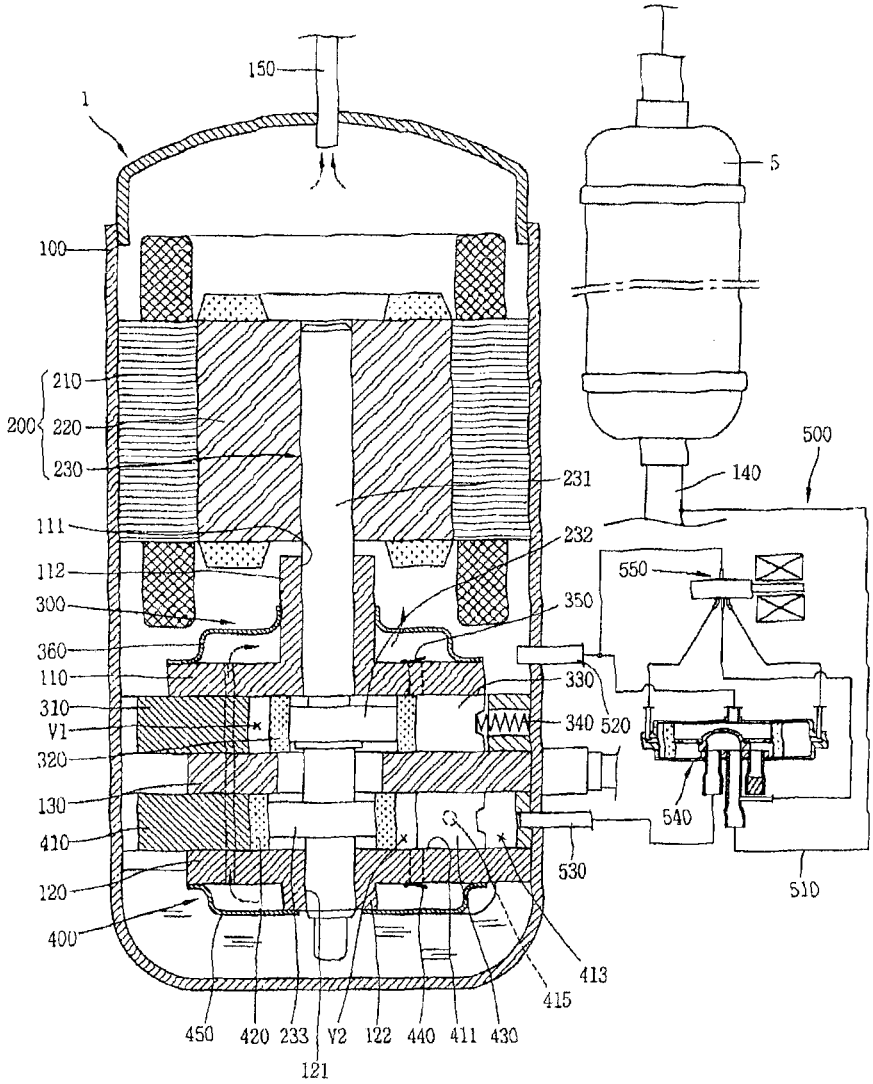
FIG. 2 is a longitudinal cross-sectional view showing an inside of the rotary compressor in accordance with FIG. 1 by being longitudinally cut based upon a vane.

The compressor 1, as shown in FIG. 2, may include a motor part 200 installed at an upper side of an inner space of a hermetic casing 100 for generating a driving force, and first and second compression parts 300 and 400 installed at a lower side of the inner space of the casing 100 for compressing a refrigerant by the driving force generated from the motor part 200. A mode switching unit 500 for switching an operation mode of the compressor 1 such that the second compression part 400 is idled if necessary may be installed outside the casing 100.

The casing 100 may have the inner space maintained in a discharge pressure state by a refrigerant discharged from the first and second compression parts 300 and 400 or from the first compression part 300. One gas suction pipe 140 through which a refrigerant is sucked between the first and second compression parts 300 and 400 may be connected to a circumferential surface of a lower portion of the casing 100. A discharge pipe 150 through which the refrigerant discharged after being compressed in the first and second compression parts 300 and 400 flows into a cooling system may be connected to an upper end of the casing 100.

The motor part 200 may include a stator 210 fixed onto an inner circumferential surface of the casing 100, a rotor 220 rotatably disposed in the stator 210, and a rotation shaft 230 shrink-fitted with the rotor 220 so as to be rotated together with the rotor 220. The motor part 200 may be implemented as a constant-speed motor or an inverter motor. However, an operation mode of the compressor can be switched by idling any one of the first and second compression parts 300 and 400, if necessary, even with employing the constant-speed motor, considering a fabricating cost.

The rotation shaft 230 may include a shaft portion 231 coupled to the rotor 220, and a first eccentric portion 232 and a second eccentric portion 233 both disposed at a lower end section of the shaft portion 231 to be eccentric to both right and left sides. The first eccentric portion 232 and the second eccentric portion 233 may be symmetric to each other with a phase difference of about 180°, and rotatably coupled respectively to a first rolling piston 340 and a second rolling piston 430, which will be explained later.

The first compression part 300 may include a first cylinder 310 formed in an annular shape and installed inside the casing 100, a first rolling piston 320 rotatably coupled to the first eccentric portion 232 of the rotation shaft 230 and configured to compress a refrigerant by being orbited in a first compression space V1 of the first cylinder 310, a first vane 330 movably coupled to the first cylinder 310 in a radial direction, with a sealing surface of its one side being contacted with an outer circumferential surface of the first rolling piston 320, and configured to partition the first compression space V1 of the first cylinder 310 into a first suction chamber and a first discharge chamber, and a vane spring 340 configured as a compression spring for elastically supporting a rear side of the first vane 330. Unexplained reference numeral 350 denotes a first discharge valve, and 360 denotes a first muffler.

The second compression part 400 may include a second cylinder 410 formed in an annular shape and installed below the first cylinder 310 inside the casing 100, a second rolling piston 420 rotatably coupled to the second eccentric portion 233 of the rotation shaft 230 and configured to compress a refrigerant by being orbited in a second compression space V2 of the second cylinder 410, and a second vane 430 movable coupled to the second cylinder 410 in a radial direction, and contacted with an outer circumferential surface of the second rolling piston 420 so as to partition the second compression space V2 of the second cylinder 410 into a second suction chamber and a second discharge chamber or spaced from the outer circumferential surface of the second rolling piston 429 so as to communicate the second suction chamber with the second discharge chamber. Unexplained reference numeral 440 denotes a second discharge valve, and 450 denotes a second muffler.

Here, an upper bearing plate 100 (hereinafter, referred to as 'upper bearing') covers the upper side of the first cylinder 310, and a lower bearing plate 120 (hereinafter, referred to as 'lower bearing') covers the lower side of the second is cylinder 410. Also, an intermediate bearing plate (hereinafter, referred to as 'intermediate bearing') 130 is interposed between the lower side of the first cylinder 310 and the upper side of the second cylinder 410 so as to support the rotation shaft 230 in a shaft direction with forming the first compression space V1 and the second compression space V2.

Figure 3:
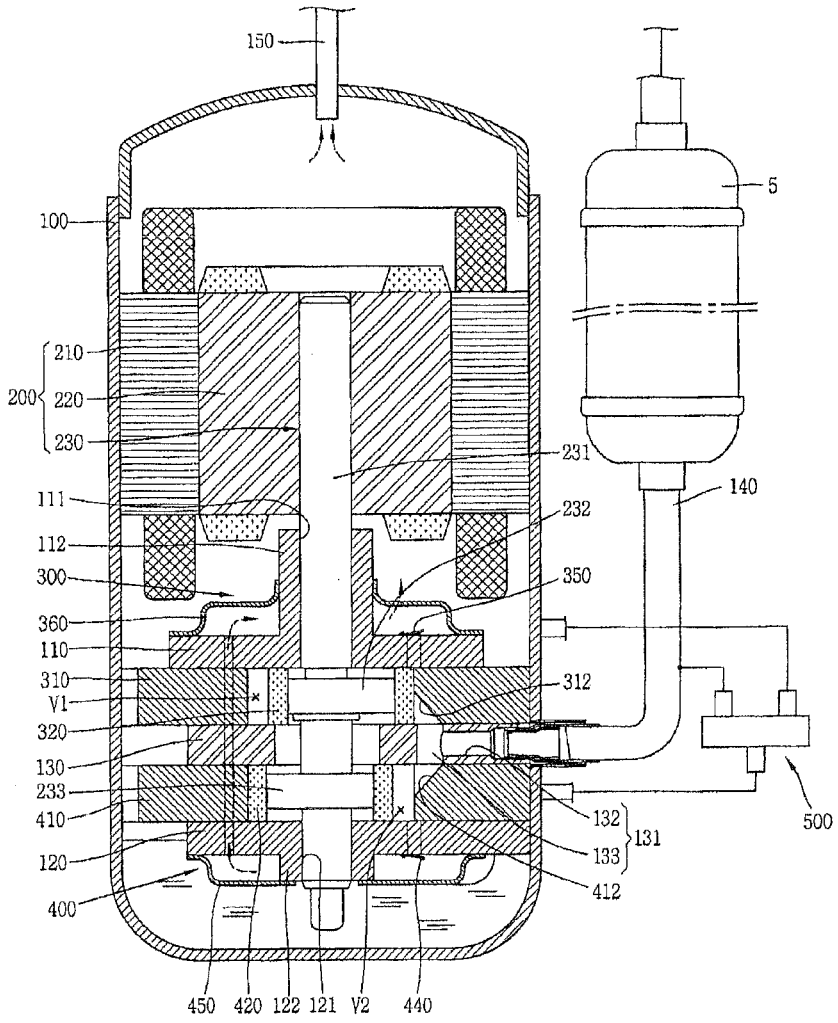
FIG. 3 is a longitudinal cross-sectional view showing an inside of the rotary compressor in accordance with FIG. 1, by being longitudinally cut based upon a suction hole.
Figure 4:
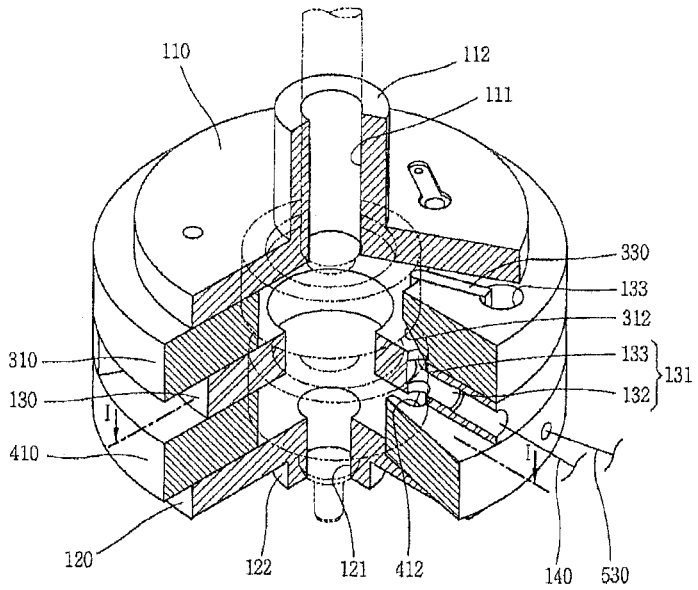
FIG. 4 is a perspective view showing a broken compression part of the rotary compressor in accordance with FIG. 1.

As shown in FIGS. 3 and 4, the upper bearing 110 and the lower bearing 120 are formed in a disc shape, and shaft supporting portions 112 and 122 having shaft holes 111 and 121 for supporting the shaft portion 231 of the rotation shaft 230 in a radial direction may protrude from respective centers thereof. The intermediate bearing 130 is formed in an annular shape with an inner diameter large enough to allow the eccentric portions of the rotation shaft 230 to be penetrated therethrough. A communication passage 131 through which a first suction hole 312 and a second suction hole 412 to be explained later can be communicated with the gas suction pipe 140 may be formed at one side of the intermediate bearing 130.

The communication passage 131 of the intermediate bearing 130 may be provided with a horizontal path 132 formed in a radial direction to be communicated with the gas suction pipe 140, and a longitudinal path 133 formed at an end of the horizontal path 132 and formed through in a shaft direction for communicating the first suction hole 312 and the second suction hole 412 with the horizontal path 132. The horizontal path 132 may be recessed by a prescribed depth from an outer circumferential surface of the intermediate bearing 130 toward an inner circumferential surface thereof, namely, by a depth not completely enough to be communicated with the inner circumferential surface of the intermediate bearing 130.

The first cylinder 310 may be provided with a first vane slot 311 formed at one side of its inner circumferential surface forming the first compression space V1 for allowing the first vane 330 to be linearly reciprocated, a first suction hole 312 formed at one side of the first vane slot 311 for inducing a refrigerant into the first compression space V1, and a first discharge guiding groove (not shown) formed at another side of the first vane slot 311 by chamfering an edge at an opposite side of the first suction hole 312 with an inclination angle, so as to guide a refrigerant to be discharged into an inner space of the first muffler 360.

The second cylinder 410 may be provided with a second vane slot 411 formed at one side of its inner circumferential surface forming the second compression space V2 for allowing the second vane 430 to be linearly reciprocated, a second suction hole 412 formed at one side of the second vane slot 411 for inducing a refrigerant into the second compression space V2, and a second discharge guiding groove (not shown) formed at another side of the second vane slot 411 by chamfering an edge at an opposite side of the second suction hole 412 with an inclination angle so as to guide a refrigerant to be discharged into an inner space of the second muffler 450.

The first suction hole 312 may be formed with an inclination angle by chamfering an edge of a lower surface of the first cylinder 310, contacted with an upper end of the longitudinal path 133 of the intermediate bearing 130, toward the inner circumferential surface of the first cylinder 310.

The second suction hole 412 may be formed with an inclination angle by chamfering an edge of an upper surface of the second cylinder 410, contacted with a lower end of the longitudinal path 133 of the intermediate bearing 130, toward the inner circumferential surface of the second cylinder 410.

Here, the second vane slot 411 may be formed by cutting (recessing) the second cylinder 410 into a preset depth in a radial direction such that the second vane 430 can be linearly reciprocated. A vane chamber 413 may be formed at a rear side of the second vane slot 411, namely, at a portion on an outer circumferential surface of the second cylinder 410, so as to be communicated with a common connection pipe 530 to be explained later.

The vane chamber 413 may be hermetically coupled by the intermediate bearing 130 and the lower bearing 120 contacting with its upper and lower surfaces so as to be isolated within the inner space of the casing 100. The vane chamber 413 may have a preset inner volume such that the rear surface of the second vane 430 can serve as a pressed surface by a refrigerant supplied via the common connection pipe 530 even if the second vane 430 is completely retracted to be accommodated within the second vane slot 411.

Figure 5:
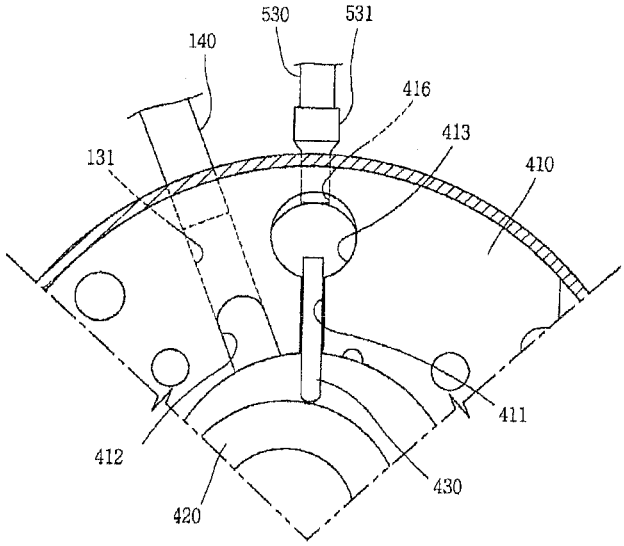
FIG. 5 is a horizontal cross-sectional view showing a connection hole and to a connection tube for connecting a common connection pipe in the rotary compressor in accordance with FIG. 1.

As shown in FIG. 5, a connection hole 416 communicated with a common connection pipe 530 to be explained later may be formed at one side of the vane chamber 413, namely, at a center of the second cylinder 410 to extend toward an outer circumferential surface of the second cylinder 410. A connection tube 531 for connecting the vane chamber 413 to the common connection pipe 530 may be inserted into the connection hole 416 for coupling.

The connection tube 531 may preferably be formed of the same material to the common connection pipe 530 because it is welded with the common connection pipe 530. Also, the connection pipe 531 may be formed to have a large diameter portion at the side being connected to the common connection pipe 530 and a small diameter portion at the side being inserted into the connection hole 416 of the second cylinder 410. The connection tube 531 may have the large diameter portion and the small diameter portion integrally formed with each other; however, a plurality of tubes having different diameters may be assembled to form the connection tube 531.

Figure 6:
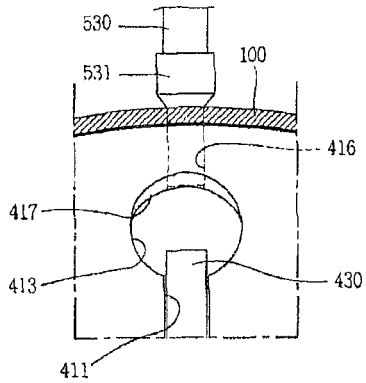
FIG. 6 is an enlarged horizontal cross-sectional view showing the connection hole and the connection tube in the rotary compressor in accordance with FIG. 5.
Figure 7:
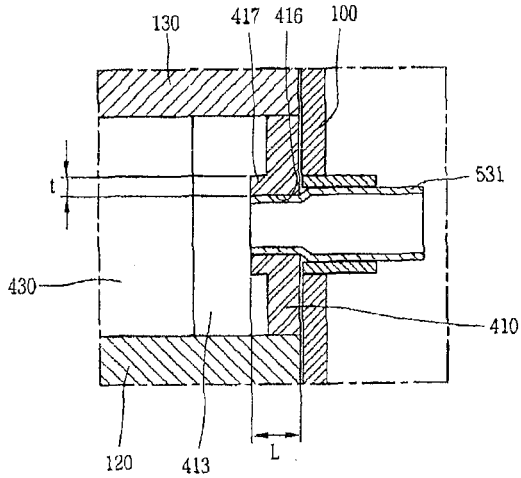
FIG. 7 is an enlarged longitudinal cross-sectional view showing a relation between the connection hole and the connection tube in the rotary compressor in accordance with FIG. 1.

As shown in FIG. 6, a connecting protrusion 417 for increasing a contact area between the connection hole 416 and the connection tube 531 may be protruded by a prescribed height from a periphery of the connection hole 416 of the second cylinder 410 in which the connection tube 531 is inserted, namely, from an inner circumferential surface of the vane chamber 413, so as to be stepped in the shaft direction. The length of the connecting protrusion 417 may preferably be shorter than a diameter of the connection hole 416 and not longer than an end of the connection tube 631. For example, referring to FIG. 7, preferably, when a length L from an outer circumferential surface of the second cylinder 410 to an end of the connecting protrusion 417, namely, the length of the connection hole 416 is more than approximately 3 mm and a thickness t of the connecting protrusion 417 is more than approximately 0.5 mm, the amount of leaked refrigerant may be minimized.

The connecting protrusion 417 may be preferably formed in a linear shape from a plane projection image; however, in some cases, it may be stepped so as to have a curvature greater that that of the vane chamber 413, as shown in FIG. 6. Accordingly, the refrigerant supplied to the vane chamber 413 can be concentrated toward the second vane 430.

Figure 8:
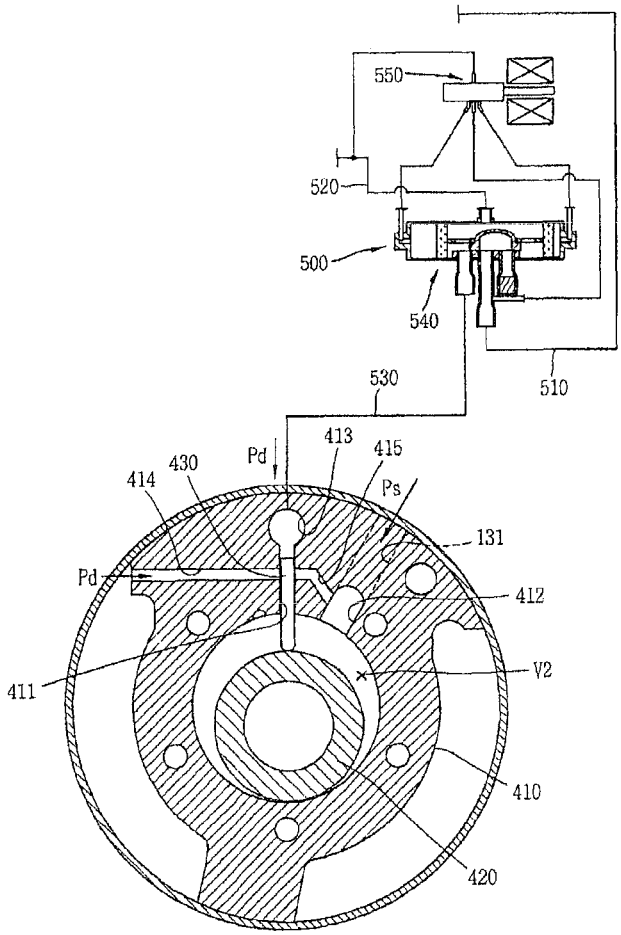
FIG. 8 is a view showing restricting passages for restricting a second vane in the rotary compressor in accordance with FIG. 1, which is a view taken along the line I-I of FIG. 4.

The pressed surface 432 of the second vane 430 is supported by a refrigerant of a suction pressure or a refrigerant of a discharge pressure filled in the vane chamber 413 such that a sealing surface 431 thereof comes in contact with or is spaced from the second rolling piston 420 according to an operation mode of the compressor. Accordingly, in order to prevent beforehand compressor noise or efficiency degradation due to the vibration of the second vane 430, the second vane 430 should be restricted within the second vane slot 411 in a particular operation mode of the compressor, i.e., in a saving mode. To this end, a restriction method for the second vane using internal pressure of the casing 100, as shown in FIG. 8, may be proposed.

For example, the second cylinder 410 may be provided with a high pressure side vane restricting passage (hereinafter, referred to as 'first restricting passage') 414 orthogonal to a motion direction of the second vane 430 or formed in a direction at least having a stagger angle with respect to the second vane 430. The first restricting passage 414 allows the inside of the casing 100 to be communicated with the second vane slot 411 such that a refrigerant of discharge pressure filled in the inner space of the casing 100 pushes the second vane 430 towards an opposite vane slot surface, thereby restricting the second vane 430. A lower pressure side vane restricting passage (hereinafter, referred to as 'second restricting passage') for allowing the second vane slot 411 to be communicated with the second suction hole 412 may be formed at an opposite side of the first restricting passage 414. The second restricting passage 415 generates a pressure difference from the first restricting passage 414 such that a refrigerant of discharge pressure introduced via the first restricting passage 414 flows through the second restricting passage 415, thereby quickly restricting the second vane 430.

The mode switching unit 500, as shown in FIGS. 1 and 2, may include a low pressure side connection pipe 510 having one end diverged from the gas suction pipe 140, a high pressure side connection pipe 520 having one end to connected to the inner space of the casing 100, a common connection pipe 530 having one end connected to the vane chamber 413 of the second cylinder 410 so as to be selectively communicated with the low pressure side connection pipe 510 and the high pressure side connection pipe 520, a first mode switching valve 540 connected to the vane chamber 413 of the second cylinder 410 via the common is connection pipe 530, and a second mode switching valve 550 connected to the first mode switching valve 540 for controlling the switching operation of the first switching valve 540.

A basic compression process of the variable capacity type rotary compressor according to the present invention will be described hereinafter.

That is, when power is applied to the stator 210 of the motor part 200 and the rotor 220 is rotated accordingly, the rotation shaft 230 is rotated together with the rotor 220 so as to transfer the rotational force of the motor part 200 to the first compression part 300 and the second compression part 400. Within the first and second compression parts 300 and 400, the first rolling piston 320 and the second rolling piston 420 are eccentrically rotated respectively in the first compression space V1 and the second compression space V2, and the first vane 330 and the second vane 430 compress a refrigerant with forming the respective compression spaces V1 and V2 with a phase difference of 180° therebetween in cooperation with the first and second rolling piston 320 and 420.

For example, upon initiating a suction process in the first compression space V1, a refrigerant is introduced into the communication passage 131 of the intermediate bearing 130 via the accumulator 5 and the suction pipe 140. Such refrigerant is sucked into the first compression space V1 via the first suction hole 312 of the first cylinder 310 to be then compressed therein. During the compression process within the first compression space V1, a suction process is initiated in the second compression space V2 of the second cylinder with the phase difference of 180° with the first compression space V1. Here, the second suction hole 412 of the second cylinder 410 is communicated with the communication passage 131 such that the refrigerant is sucked into the second compression space V2 via the second suction hole 412 of the second cylinder 410 is to be then compressed therein.

In the meantime, a process of varying the capacity of the variable capacity type rotary compressor will be described hereinafter.

Figure 9:
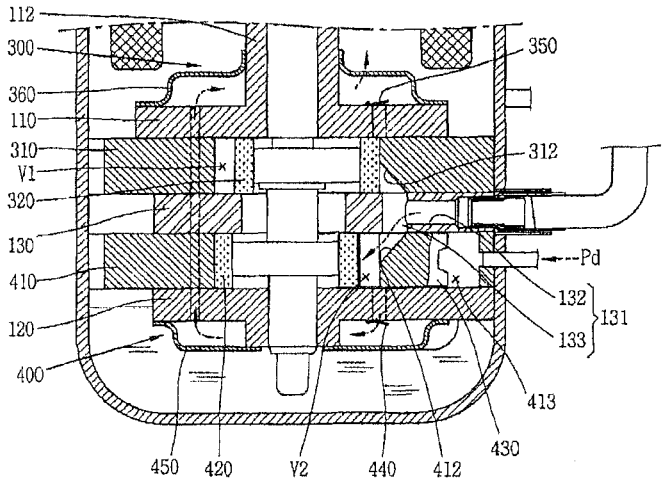
FIGS. 9 and 10 are longitudinal and horizontal cross-sectional views showing a power mode of the rotary compressor in accordance with FIG. 1.
Figure 10:
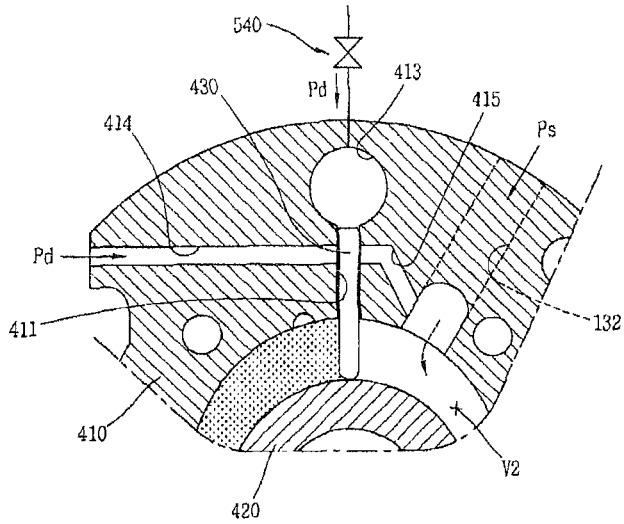

That is, even in case where the compressor or an air conditioner having the same is operated in a power mode, as shown in FIGS. 9 and 10, power is applied to the first mode switching valve 540, accordingly, the low pressure type connection pipe 510 is blocked while the high pressure type connection pipe 520 is connected to the common connection pipe 530. Accordingly, a high pressure gas within the casing 100 is supplied into the vane chamber 413 of the second cylinder 410 via the high pressure side connection pipe 520.

The second vane 430 is then pushed by the high pressure refrigerant filled in the vane chamber 413 to be maintained in a state of being press-contacted with the second rolling piston 420. Hence, the refrigerant gas introduced into the second compression space V2 is normally compressed and discharged.

Here, the high pressure refrigerant gas or oil is applied via the first restricting passage 414 disposed in the second cylinder 410 so as to press one side surface of the second vane 430. However, as the sectional area of the first restricting passage 414 is narrower than that of the second vane slot 411, the pressure applied to the side surface of the second vane 430 is lower than the pressure applied thereto in back and forth directions within the vane chamber 413, accordingly the second vane 430 is not restricted. Therefore, the second vane 430 partitions the second compression space V2 into a suction chamber and a discharge chamber by being press-contacted with the second rolling piston 420, such that the entire refrigerant sucked into the second compression space V2 is compressed and discharged. Accordingly, the compressor or the air conditioner having the same can be operated with 100% of capacity.

Figure 11:
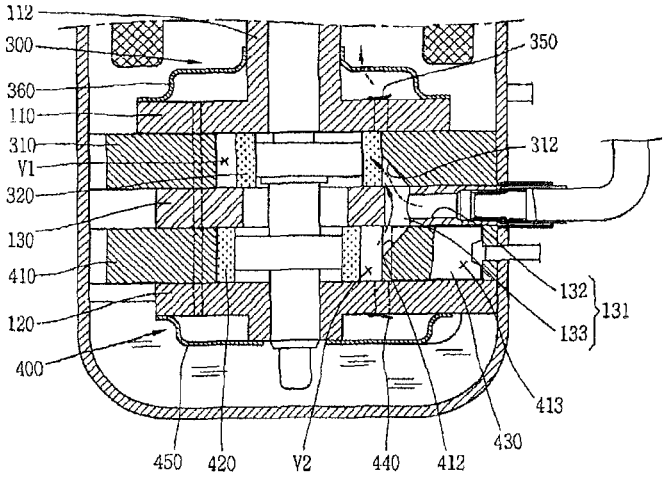
FIGS. 11 and 12 are longitudinal and horizontal cross-sectional views showing a saving mode of the rotary compressor in accordance with FIG. 1.
Figure 12:
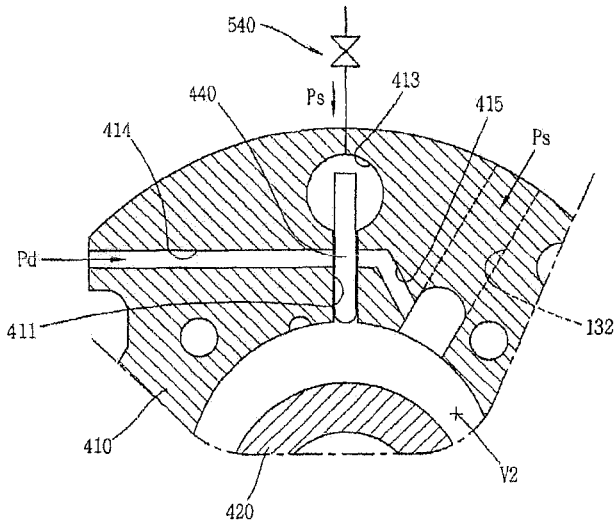

On the other hand, in a saving mode, such as upon initiating the compressor or the air conditioner having the same, as shown in FIGS. 11 and 12, power is not supplied to the first mode switching valve 540. Accordingly, contrary to the power mode, the low pressure side connection pipe 510 is communicated with the common connection pipe 530 and a lower pressure refrigerant (gas) sucked into the second cylinder 410 is partially introduced into the vane chamber 413. Consequently, the second vane 430 is pushed by the refrigerant compressed in the second compression space V2 so as to be accommodated within the second vane slot 411. The suction chamber and the discharge chamber of the second compression space V2 are accordingly communicated with each other, and thereby the refrigerant gas sucked into the second compression space V2 cannot be compressed.

Here, a great pressure difference occurs between the pressure applied to one side surface of the second vane 430 by the first restricting passage 414 disposed in the second cylinder 410 and the pressure applied to another side surface of the second vane 430 by the second restricting passage 415. Accordingly, the pressure applied via the first restricting passage 414 shows a tendency to move toward the second restricting passage 415, thereby rapidly restricting the second vane 430 without vibration. In addition, at the time when the pressure of the vane chamber 413 is converted from discharge pressure into suction pressure, the discharge pressure remains in the vane chamber 413 so as to form a type of intermediate pressure Pm. However, the intermediate pressure Pm of the vane chamber 413 is leaked via the second restricting passage 415 with pressure lower than that. Accordingly, the pressure of the vane chamber 413 is fast converted into the suction pressure Ps, resulting in much quickly preventing the vibration of the second vane 430. Hence, the second vane 430 can be is restricted fast and effectively. Therefore, as the second compression space of the second cylinder 410 is communicated into one space, the entire refrigerant sucked into the second compression space V2 of the second cylinder 410 is not compressed but flows along the track of the second rolling piston. Part of the refrigerant is moved into the first compression space V1 via the communication passage 131 and the first suction hole 312 due to the pressure difference, so the second compression part 400 is not operated. Consequently, the compressor or the air conditioner having the same is operated only with the capacity of the first compression part. Also, during this process, the refrigerant within the second compression space V2 flows into the first compression space V1 without flowing back into the accumulator 5, thereby preventing the overheat of the accumulator 5, resulting in the reduction of suction loss.

Figure 13:
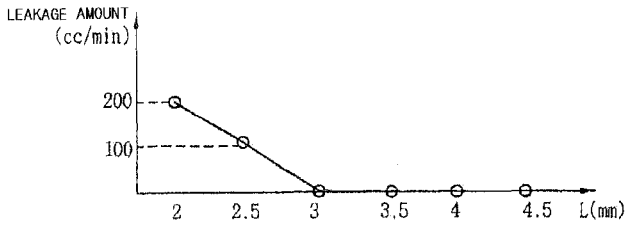
FIGS. 13 and 14 are graphs showing the changes in an amount of leaked refrigerant and the performance of the compressor depending on the changes in a sealing area between the connection hole and the connection tube in the rotary compressor in accordance with the present invention.
Figure 14:
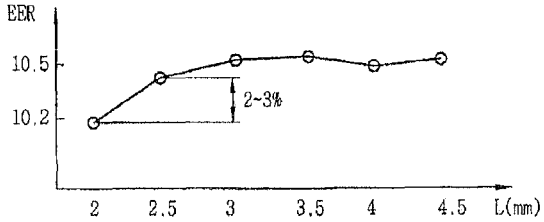

Here, when the vane chamber 413 is formed in the second cylinder 410, the vane chamber 413 is formed near the outer circumferential surface of the second cylinder 410. Accordingly, a minimum thickness between an inner circumferential surface of the vane chamber 413 and the outer circumferential surface of the second cylinder 410 becomes thin, and thereby the length of the connection hole 416 becomes short. Hence, the sealing area between the connection hole 416 and the connection tube 531 can be decreased. Therefore, if the connecting protrusion 417 is protruded with being stepped from the inner circumferential surface of the vane chamber 413 so as to form the connection hole more than 3 mm in length as shown in the present invention, the sealing area between the connection hole 416 and the connection tube 531 can be increased, as shown in FIG. 13, and also the amount of leaked refrigerant from the vane chamber 413 can be remarkably reduced. Hence, as shown in FIG. 14, a mode switching of the second vane 430 is fast and accurately be achieved, accordingly improvement of the performance EER of the compressor can be ensured approximately 2~3% and also noise occurred due to the vibration of the vane can be prevented in advance.

Figure 15:
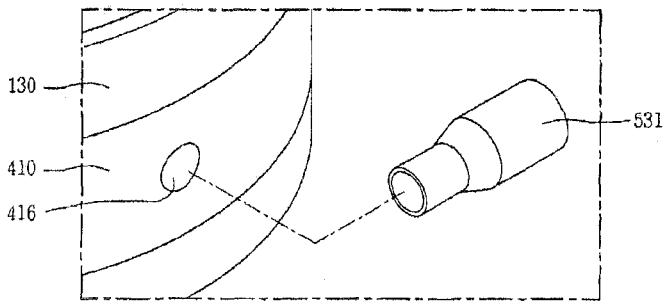
FIG. 15 is an enlarged perspective view showing the connection hole and the connection tube in the rotary compressor in accordance with FIG. 5.
Figure 16:
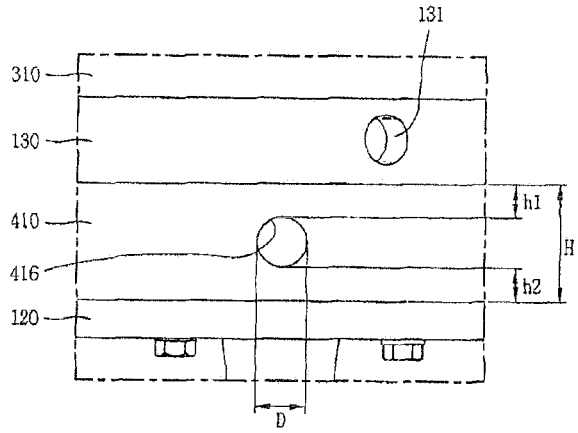
FIG. 16 is a front view showing the size of the connection hole in accordance with FIG. 5.
Figure 17:
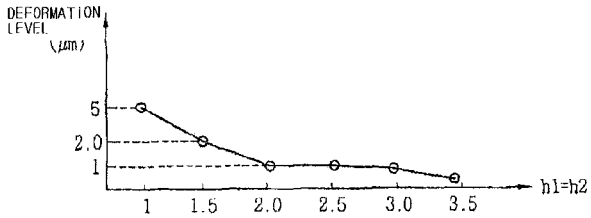
FIGS. 17 and 18 are graphs showing the deformation level of a cylinder and the changes in the performance of the compressor depending on the changes in a thickness of both sides of the connection hole in the rotary compressor in accordance with the present invention.
Figure 18:
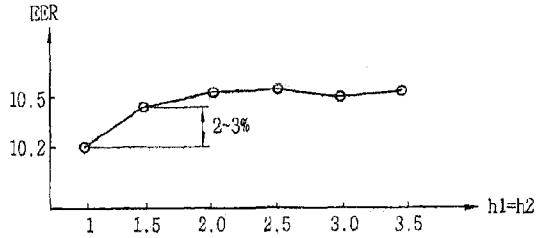

In addition, in case where the vane chamber 413 is formed in the second cylinder 410 and the connection hole 416 communicated with the vane chamber 413 is formed, if the thicknesses between both sides of the connection hole 413 and both side surfaces of the second cylinder 410 are extremely thin, the second cylinder 410 may be deformed when press-fitting the connection tube 531 into the connection hole 416, which may generate gaps between the second cylinder 413 and both bearings 120 ad 130. Accordingly, it is apprehended that a refrigerant can be leaked out of the vane chamber 413 or out of the compression space V2. Therefore, the present invention, as shown in FIGS. 15 and 16, designates the size of the second cylinder 410, namely, the thicknesses between both upper and lower sides of the connection hole 416 and both upper and lower side surfaces of the second cylinder 410, so as to prevent the deformation of the second cylinder 410 occurred when assembling the connection hole 416 into the connection tube 531. Accordingly, the gap generation between the second cylinder 410 and the bearings 120 and 130 can be prevented, which thusly prevents the refrigerant from being leaked out of the vane chamber 413 or the compression space V2, thereby improving the performance of the compressor. FIGS. 17 and 18 are graphs showing the deformation level of the cylinder and the changes in the performance of the compressor depending on the changes in the thicknesses between the connection hole and both side surfaces of the second cylinder. As shown in the graphs, it can be noticed that when the thicknesses are more than approximately 1.5 mm, the deformation level is maintained less than 2.0 μm and approximately 2~3% improvement is achieved for the performance.

Figure 19:
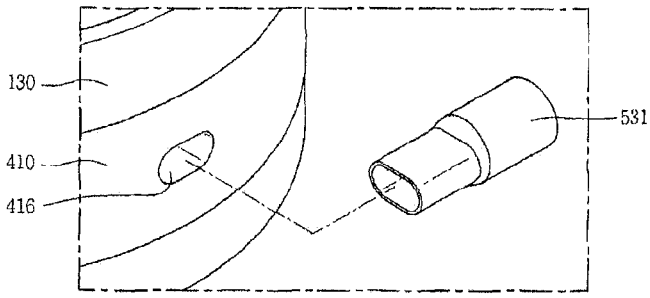
FIG. 19 is a perspective view showing an other embodiment of a connection hole and a connection tube for connecting a common connection pipe in the rotary compressor in accordance with FIG. 1.
Figure 20:
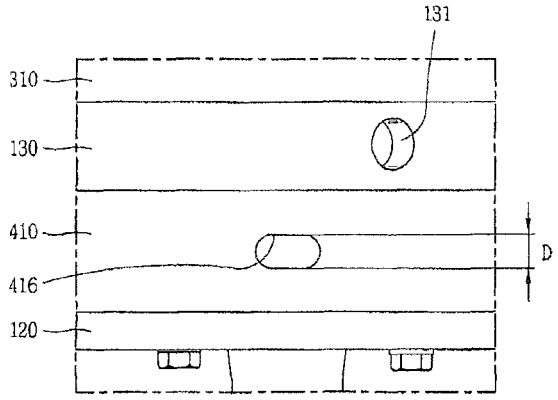
FIG. 20 is a front view showing the size of the connection hole in is accordance with FIG. 9.

Meanwhile, the connection hole may be formed in a rectangular shape other than a right circular shape. For instance, as shown in FIGS. 19 and 20, the connection hole 416 may be formed in a rectangular shape slightly long in a longitudinal direction so that the thicknesses from both sides of the connection hole 416 to the both upper and lower side surfaces of the second cylinder 410 can be formed thicker than those in the right circular shape. In this case, a small diameter portion of the connection tube 531 may also be formed in the rectangular shape. Also, a long diameter of the small diameter portion may preferably be formed not greater than a long diameter of the large diameter portion, in view of the small diameter portion of the connection tube 531 being inserted into the hermetic container from the outside thereof to be then welded.

In the meantime, another embodiment of a rotary compressor in accordance with the present invention will be described as follows.

Figure 21:
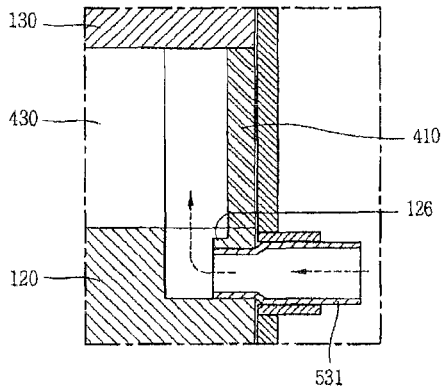
FIG. 21 is a main part longitudinal cross-sectional view showing an embodiment of coupling a connection tube to a lower bearing in a rotary compressor in accordance with the present invention.

That is, the aforesaid embodiment has illustrated that the connection hole is formed in the second cylinder; however, this embodiment illustrates that the connection hole is formed at the lower bearing. Here, as shown in FIG. 21, the lower bearing 120 is provided with a connection hole 125 curvedly formed from an upper surface of the lower bearing 120 toward an outer circumferential surface thereof for communicating the vane chamber 413 of the second cylinder 410 with the common connection pipe 530 of the mode switching unit 500. Also, a connecting protrusion 126, similar to that in the previous embodiment, is protruded from an inner circumferential surface of a vane chamber side of the connection hole 125 with being stepped.

Here, the shape of the connecting protrusion and an effect made thereby are the same to those in the previous embodiment, so a detailed description thereof will not be repeated. However, when the connection hole 125 is formed at is the lower bearing 120, the deformation of the second cylinder 410 caused upon inserting the connection tube 531 can be prevented, whereby the second rolling piston 420 or the second vane 430 can stably move, thereby improving the performance of the compressor.

Further, although not shown in the drawings, the connection hole may be formed at the intermediate bearing other than the lower bearing. Also, when the vane chamber is formed in the first cylinder, the connection hole may be formed at the upper bearing or intermediate bearing as well as the first cylinder. Even in this case, it may be formed the same to those in the previous embodiments.

INDUSTRIAL AVAILABILITY

The embodiment of the present invention is applied to a double type rotary compressor; but may be applicable to a single type rotary compressor having a vane chamber. Also, the rotary compressor in accordance with the present invention may be widely applied to cooling apparatuses employing a refrigerant compression type refrigerating cycle, such as air conditioners.

The invention claimed is:

1. A rotary compressor comprising:

at least one cylinder installed in an inner space of a hermetic container, having a compression space for compressing a refrigerant, and provided with a vane chamber isolated within the inner space of the hermetic container;

a plurality of bearings coupled to both upper and lower sides of the at least one cylinder so as to cover the compression space of the at least one cylinder and the vane chamber;

at least one rolling piston configured to compress the refrigerant by being orbited in the compression space of the at least one cylinder;

at least one vane slidably coupled to the at least one cylinder and configured to partition the compression space into a suction chamber and a discharge chamber in cooperation with the at least one rolling piston, at least one vane being supported by a refrigerant filled in the vane chamber of the at least one cylinder; and a mode switching unit configured to vary an operation mode of the rotary compressor by selectively supplying a refrigerant of suction pressure or a refrigerant of discharge pressure to the vane chamber of the at least one cylinder, wherein the at least one cylinder is provided with a connection hole for allowing the vane chamber to be communicated with the mode switching unit, the vane chamber of the at least one cylinder being provided with a connecting protrusion protruded from an inner circumferential surface of the vane chamber with being stepped;

and wherein a connection tube is inserted into at least a portion of the connection hole where the connecting protrusion is stepped.

2. The rotary compressor of claim 1, a curvature of an end of the connecting protrusion is different from a curvature of the inner circumferential surface of the vane chamber.

3. The rotary compressor of claim 1, wherein the connection tube is inserted into the connection hole for allowing the connection of a connection pipe of the mode switching unit.

4. The rotary compressor of claim 3, wherein the connection tube is provided with a large diameter portion connected to the connection pipe of the mode switching unit, and a small diameter portion inserted into the connection hole.

5. The rotary compressor of claim 3, wherein the length of the connecting protrusion is shorter than a diameter of the connection hole and not longer than an end of the connection tube.

6. The rotary compressor of claim 3, wherein a length from the outer circumferential surface of the at least one cylinder to the end of the connecting protrusion is more than approximately 3 mm.

7. The rotary compressor of claim 3, wherein the thickness of the connecting protrusion is more than approximately 0.5 mm.

8. The rotary compressor of claim 3, wherein a diameter D of the connection hole is in the range of 20 to 70% of a thickness H of the at least one cylinder.

9. The rotary compressor of claim 3, wherein the connection hole is formed to have a long diameter and a short diameter, the short diameter of the connection hole being in the range of 20 to 70% of a thickness of the at least one cylinder.

10. The rotary compressor of claim 9, wherein the connection tube has a large diameter portion formed in a right circular shape and a small diameter portion formed with long diameter and short diameter corresponding to those of the connection hole, the small diameter portion of the connection tube having the long diameter not greater than a diameter of the large diameter portion.

11. A rotary compressor comprising:

at least one cylinder installed in an inner space of a hermetic container, having a compression space for compressing a refrigerant, and provided with a vane chamber isolated within the inner space of the hermetic container;

a plurality of bearings coupled to both upper and lower sides of the at least one cylinder so as to cover the compression space of the at least one cylinder and the vane chamber;

at least one rolling piston configured to compress the refrigerant by being orbited in the compression space of the at least one cylinder;

at least one vane slidably coupled to the at least one cylinder and configured to partition the compression space into a suction chamber and a discharge chamber in cooperation with the at least one rolling piston, at least one vane being supported by a refrigerant filled in the vane chamber of the at least one cylinder; and a mode switching unit configured to vary an operation mode of the rotary compressor by selectively supplying a refrigerant of suction pressure or a refrigerant of discharge pressure to the vane chamber of the at least one cylinder, wherein one of the bearings is provided with a connection hole for connecting the mode switching unit to the vane chamber, and a connecting protrusion is formed at an inner circumferential surface at a chamber side of the connection hole with being stepped;

and wherein a connection tube is inserted into at least a portion of the connection hole where the connecting protrusion is stepped.

12. The rotary compressor of claim 11, a curvature of an end of the connecting protrusion is different from a curvature of the inner circumferential surface of the vane chamber.

13. The rotary compressor of claim 11, wherein the connection tube is inserted into the connection hole for allowing the connection of a connection pipe of the mode switching unit.

14. The rotary compressor of claim 13, wherein the connection tube is provided with a large diameter portion connected to the connection pipe of the mode switching unit, and a small diameter portion inserted into the connection hole.

15. The rotary compressor of claim 13, wherein the length of the connecting protrusion is shorter than a diameter of the connection hole and not longer than an end of the connection tube.

16. The rotary compressor of claim 13, wherein a length from the outer circumferential surface of the at least one cylinder to the end of the connecting protrusion is more than approximately 3 mm.

17. The rotary compressor of claim 13, wherein the thickness of the connecting protrusion is more than approximately 0.5 mm.

18. The rotary compressor of claim 13, wherein a diameter D of the connection hole is in the range of 20 to 70% of a thickness H of the at least one cylinder.

19. The rotary compressor of claim 13, wherein the connection hole is formed to have a long diameter and a short diameter, the short diameter of the connection hole being in the range of 20 to 70% of a thickness of the at least one cylinder.

20. The rotary compressor of claim 19, wherein the connection tube has a large diameter portion formed in a right circular shape and a small diameter portion formed with long diameter and short diameter corresponding to those of the connection hole, the small diameter portion of the connection tube having the long diameter not greater than a diameter of the large diameter portion.

* * * * *